United States Patent [19]

Harrison et al.

[11] Patent Number: 4,468,875

[45] Date of Patent: Sep. 4, 1984

[54] CARTRIDGE MAGAZINE FOR DIRECT EJECTION OF A CARTRIDGE INTO THE FIRING CHAMBER OF A FIREARM

[75] Inventors: Edwin L. Harrison, Whittier; Ronald D. Retzlaff, Anaheim, both of Calif.

[73] Assignee: Creative Metal Forming, Inc., Anaheim, Calif.

[21] Appl. No.: 380,097

[22] Filed: May 20, 1982

[51] Int. Cl.[3] ..... F41C 25/02; F41C 25/00; F41D 10/12

[52] U.S. Cl. ..... 42/50; 89/33.16

[58] Field of Search ..... 89/33 BC, 33 BB, 33 BA, 89/33 B, 33 D, 34; 42/6, 49 R, 50, 17-19, 7

[56] References Cited

U.S. PATENT DOCUMENTS

| | | | |
|---|---|---|---|
| 1,314,013 | 8/1919 | Mulvey | 42/7 X |
| 1,436,232 | 11/1922 | Bohnak | 89/33 BC |
| 2,180,741 | 11/1939 | Lisov | 42/6 X |
| 4,109,401 | 8/1978 | Musgrave | 42/50 |
| 4,384,508 | 5/1983 | Sullivan et al. | 89/33 D |

FOREIGN PATENT DOCUMENTS

| | | | |
|---|---|---|---|
| 1002098 | 3/1952 | France | 89/33 B |

*Primary Examiner*—Richard E. Schafer
*Assistant Examiner*—David Kent Cornwell
*Attorney, Agent, or Firm*—Gerald L. Price

[57] ABSTRACT

A removable cartridge magazine for firearms adapted to engage the firing chamber of a firearm comprising an elongated housing, a first gear rotatably mounted in one end of the housing adjacent the portion of the housing that engages the firing chamber of the firearm, a second gear mounted at the other end of the housing, an endless belt encircling the gears and engagable therewith whereby rotation of said gears rotates said belt, the belt being spaced inwardly from the inner wall of the housing, a plurality of spaced shell receiving compartments mounted along the outer periphery of said belt adjacent the inner wall of the housing, each compartment being an elongated groove extending longitudinally across the outer surface of the belt adjacent the inner wall of the housing in a direction traverse to the direction of movement of the belt. Each compartment is adapted to receive a cartridge shell therein which is retained in position on the belt between the inner wall of the housing and the compartment and each compartment is selectively presented into position for direct ejection into the firing chamber when the belt is rotated. The gears are motor driven and various components of the magazine may be of molded plastic with a transparent cover so that the capacity of the magazine is clearly visible.

10 Claims, 3 Drawing Figures

CARTRIDGE MAGAZINE FOR DIRECT EJECTION OF A CARTRIDGE INTO THE FIRING CHAMBER OF A FIREARM

BACKGROUND OF THE INVENTION

1. Field of the Invention

The invention relates to cartridge magazines; and, more particularly, to a large capacity magazine adapted to hold a large number of shells and present selective shells for ejection into the firing chamber of a firearm when actuated.

2. Description of the Prior Art

Cartridge feeding devices for firearms are well known in the art. Such devices are removably attached to a firearm and automatically feed cartridges into the firing chamber of the firearm. For example, U.S. Pat. No. 1,314,013 to Mulvey discloses a spring motor driven magazine having an endless belt encircling spaced drums with spaced shelves on the outer periphery of the belt for receiving cartridges therein. The belt is not directly keyed to the drums and may slip after repeated usage thus causing misalignment and malfunction. Also, an elaborate mechanism is necessary for feeding selective cartridges into the firing chamber since the cartridges are not fed directly from the belt into the chamber. Earlier patents, such as U.S. Pat. No. 52,248 to Josselyn and U.S. Pat. No. 672,300 to Turnbull, also show endless belt feeds in a magazine. In Josselyn, the cartridge chambers are actually links in the chain and cannot be easily and quickly reloaded. In fact, the cartridges must be of a certain predetermined shape and configuration to fit into the chain thus rendering the device impractical. Turnbull's magazine is not motor driven and the magazine is an integral part of the pistol and not easily separated or detached.

U.S. Pat. No. 2,865,126 to Dardick illustrates a magazine-fed open chamber revolver but one which is adapted to be used with a uniquely shaped cartridge and is not motor driven. In U.S. Pat. No. 1,436,232 to Bohnak, an endless belt extends about a pair of spaced rollers rotatable by a gearing system. However, the cartridges are not fed into position for direct ejection into the firing chamber and a rather elaborate gearing system is used to rotate the rollers.

U.S. Pat. Nos. 111,827; 1,042,837; 1,368,375; 1,921,871; 2,007,774; and 2,180,741 have been considered but are deficient for many reasons in that they do not have large capacity removable magazines for feeding cartridges at a proper orientation for direct ejection into the firing chamber.

There is thus a need for a large capacity removable magazine for firearms for feeding selective cartridges into a firing chamber that is easy to use, has visible means for determining the loaded capacity of the magazine, is self-contained, feeds cartridges into position for direct ejection into the firing chamber in proper firing position and cannot be overwound in operation.

SUMMARY OF THE INVENTION

It is an object of this invention to provide an improved large capacity removable cartridge magazine which feeds via an endless motor driven belt a plurality of cartridges into position for direct ejection into the firing chamber of a firearm in proper firing orientation.

It is another object of this invention to provide such magazine which has visible means for determining the loaded or unloaded state of the magazine.

It is still another object of this invention to provide such a magazine which has an endless belt having cartridge receiving chambers on the outer periphery and direct drum engaging means on its inner periphery.

It is still further an object of this invention to provide a magazine that is easy to manufacture and can easily be transported and snapped into operating position.

These and other objects are preferably accomplished by providing a removable magazine that snap fits onto the firing chamber of a firearm and which includes an elongated housing, a first gear rotatably mounted on one end of the housing adjacent the portion of the housing that engages the firing chamber of the firearm, a second gear mounted at the other end of the housing, an endless belt encircling the gears and engageable therewith whereby rotation of said gears rotates said belt. The belt is spaced from the inner wall of the housing and a plurality of spaced shell receiving compartments are mounted along the outer periphery of the belt, each compartment being an elongated groove extending longitudinally across the surface of the belt in a direction traverse to the direction of movement of the belt. Each compartment is adapted to receive a cartridge shell therein which is loosely retained in position on the belt between the inner walls of the housing and the wall of the compartment. Each compartment is selectively presented into position for direct ejection into the firing chamber when the belt is rotated. The gears are motor driven and various components of the magazine may be of molded plastic with a transparent cover so that the capacity of the magazine is clearly visible.

DESCRIPTION OF THE PREFERRED EMBODIMENT

Figure 1:
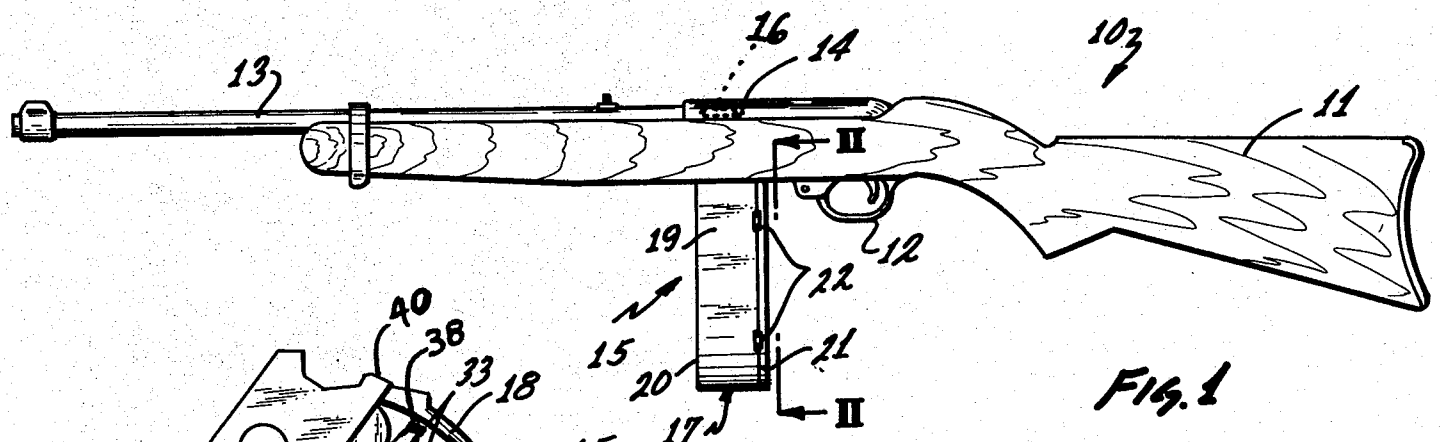
FIG. 1 is a vertical view of a firearm having the magazine of the invention attached thereto.

Referring now to FIG. 1 of the drawing, a conventional firearm 10 is shown having a butt 11, a trigger 12, a barrel 13 and a firing chamber 14. As particularly contemplated in the present invention, a removable magazine 15 is shown coupled to firing chamber 14. It is to be understood that, except for magazine 15 as will be described hereinafter, the firearm 10 may be any conventional firearm adapted to receive a magagine containing a plurality of cartridges and eject cartridges one at a time into firing position. Magazine 15 is conventional only insofar as its coupling mechanism to firing chamber 14 which coupling mechanism is well known in the firearm art and, of course, may vary depending on the firearm. The means for engaging the cartridges present in cartridge chamber 14, such as cartridge 16 shown in dotted lines in FIG. 1, is also conventional and well known in the art and further description is deemed unnecessary.

Figure 2:
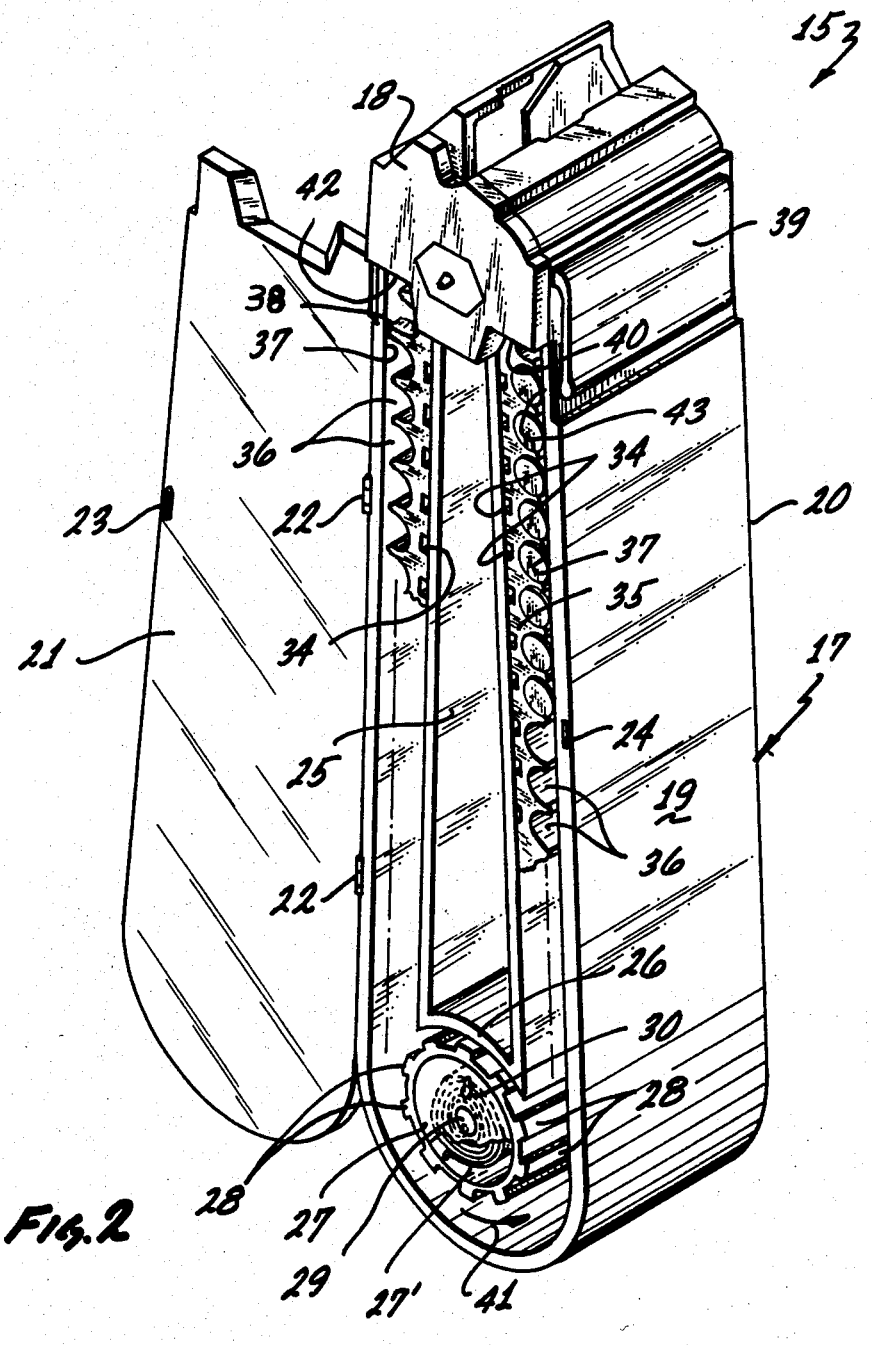
FIG. 2 is a view taken along lines II—II of FIG. 1 showing the magazine alone of the invention.

Referring now to FIG. 2, the magazine 15 is shown removed from firearm 10 and includes a main elongated housing 17 connected at one end to a conventional clip portion 18, as heretofore discussed, which again is known in the art and would vary in configuration from the one shown depending upon the configuration of the particular firearm. Such clip portion 18 quickly and easily snap fits onto the firing chamber 14 of firearm 10 of FIG. 1 and is quickly and easily detached therefrom.

Housing 17 extends from clip portion 18 having an outer peripheral wall 19 larger in width at the bottom than at the top. Housing 17 includes an integral back wall 20 and a front wall 21. If desired, front wall 21 may be hinged at hinges 22 to wall 19 of housing 17 and any suitable locking means, if desired, may be provided. For example, mating magnetic strips 23,24 may be provided on the interior of front wall 21 and the inner edge of peripheral wall 19, respectively, as shown, for providing a lock. Of course, more positive locking means, such as a key lock, may be provided, if desired. Alternatively, hinges 22 may be spring hinges which normally bias wall 21 into a closed position. Also, wall 21 need not be hinged to wall 19 and may slip off or snap fit into position and be easily removable therefrom as is well known in the art.

Wall 21 may also be transparent so as to provide a visible indication of the loading status of magazine 15.

An interior support structure 25 may be provided extending down from clip portion 18 and spaced from wall 19 as shown to provide strength and reinforcement to magazine 15. As shown, structure 25 is curved at the bottom 26 to provide a generally circular open chamber at the bottom of magazine 15 having mounted therein a conventional key-driven spring wound drum 27 having an internal spring 27' mounted therein as shown in dotted lines. Drum 27 includes spaced gear teeth 28 on its outer periphery and is rotatable about shaft 29 fixedly secured to rear wall 20. A key receiving aperture 30 is providing for receiving a key therein for winding up the spring motor of drum 27. Means well known in the art may be provided internally of drum 27 for winding motor in only one direction.

Figure 3:
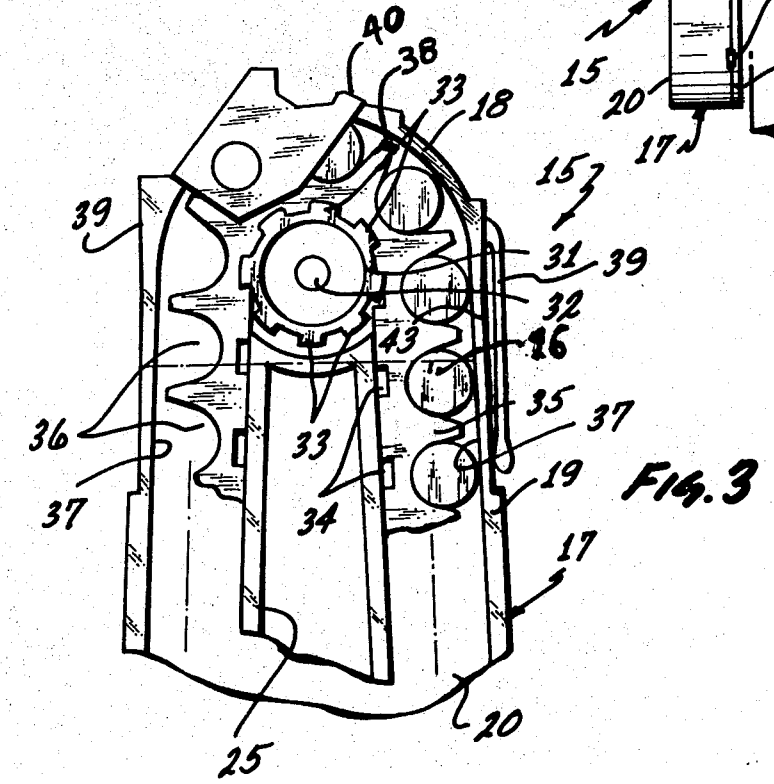
FIG. 3 is a vertical view in cross-section of the upper end of the magazine alone of FIG. 2.

As seen in FIG. 3, an idler drum 31 is rotatably mounted on a shaft 32 fixedly mounted in the interior of clip portion 18. Drum 31 also has gear teeth 33 on its outer periphery, teeth 28 and 33 meshing with gear teeth 34 on the inner surface of an endless belt 35 extending about drums 27,31. Belt 35 also has a plurality of spaced cartridge receiving chambers 36 adapted to receive therein a plurality of cartridges 16. As can be seen in FIG. 2, the inner wall 37 and the walls of the chamber 36 serve to maintain cartridges 16 in position on belt 35. Also, as can be seen, a substantial number of cartridges 16 may be provided on belt 35. The chambers 36 are arcuate in cross-section conforming to the substantially cylindrical shape of conventional cartridges. The axes of chambers 36 extend transverse to the direction of movement of belt 35 and bring selective ones of the cartridges to the top of the magazine (FIG. 3) where they are in a position to be ejected directly into firing position in chamber 14 oriented in the proper direction as is well known in the art. The angularity of chambers 36 is of course selected to deliver the cartridges at the proper orientation.

Movement of the cartridges 16 in chambers 36 in the axial direction of chambers 36 is prevented by the front and rear walls 21,20, respectively.

As discussed heretofore, the front wall 21 may be of clear plastic thus enabling the user to see the amount of ammunition present in magazine 15. Also, indicia 37 may be provided at each chamber 36 so that the total number of cartridges remaining in the magazine 15 can be quickly and easily determined.

The various components of magazine 15 such as housing 17 (comprising front and rear walls 20,21, peripheral wall 19 and wall structure 25) may be of molded plastic. In this manner, alignment of parts is controlled and various parts, e.g., the clip portion 18, drums 27, 31, etc, may be mounted to housing 17 without need for additional mechanical fastening means, as by snap fitting thereon. The outer wall of drum 27 acts as a retainer to keep spring 27' therein. The aperture 30 is actuated by insertion therein of a key for winding drum 27 in one direction. The key (not shown), if desired, may be stored internally of magazine 15 (as in structure 25) when not used. Of course, other means known in the art may be provided on drum 27 for ensuring winding in the proper direction and preventing unwinding.

Belt 35 may also be a molded unit and includes a follower 38 or other suitable means molded thereon adapted to engage the underside of ledge 40 to prevent overwinding and prevent unwinding after the last round of ammunition is expended from the delivery chute into firing chamber 14. Such follower 38 and ledge 40 also allow the delivery of the last round of ammunition to the delivery chute of the firing chamber 14. Thus, as shown in FIG. 2, a key is inserted into keyhole 30 and spring 27' is wound rotating drum 27 in the direction of arrow 41. When follower 38 hits or abuts against ledge 40, the belt 35 stops but the final cartridge within clip portion 18 may be ejected. The motor may then be rewound to bring follower 38 back to the beginning (e.g., abutting ledge 42). The indicia 37 of course along each chamber 36 of belt 35 clearly and quickly indicates the amount of ammunition left. The upper portion of housing 17 may also include an external clip 39 molded thereon and spaced from the outer wall 43 of clip portion 18 so magazine 15 may be quickly and easily fastened to, and be carried on, a trouser belt or the like.

It can be seen that we have described a magazine which can be made of easily molded parts that snap together, are of any suitable dimensions and thus easily adapted to any desired capacity and of any suitable length and configuration. The clip portion may be a standard clip of the firearm to which it is desired to be mounted. For example, one can take a conventional firearm, remove its clip, remove the magazine thereon in any suitable manner, and install the magazine of the invention while retaining the connection of the clip portion as shown in FIG. 2. Thus, in FIG. 2, clip portion 18 forms no part of our invention, other than in the environment shown and described, and may in fact vary depending on the particular installation.

As heretofore discussed, the magazine is of extremely large capacity, may be transparent and marked along the belt chambers for determining its capacity and made from molded plastic parts, wherever possible, then quickly and easily snap-fit together. The teeth 28 of drum 27 and teeth 33 of idler drum 31 directly and positively engage the belt 35. Of course, the idler drum may be at the bottom and the drive drum at the top, if desired. Any well known means may be provided for allowing rotation of drum 27 in only one direction and preventing overwinding. Of course, any suitable motive means may be provided as is known to an artisan in place of spring motor 27'.

It can be seen that we have described a large capacity magazine for delivering ammunition to the firing chamber of a firearm at the correct angle for the delivery chute of the firing chamber. The magazine may be made of inexpensive molded parts which may be snapped together and made to any suitable dimensions.

We claim:

1. In a magazine for firearms having a clip portion adapted to snap-fit into the receiver portion of a firearm and adjacent the breach of the firing chamber thereof and to selectively present cartridges carried thereby into position for direct ejection therefrom into such firing chamber, the improvement comprising:

said magazine including an elongated housing extending from said clip portion having an outer peripheral wall, a rear wall closing off the back of said housing and a front wall closing off the front of said housing thereby providing an enclosed chamber extending from said clip portion to said housing portion;

a first drum rotatably mounted internally of said chamber within the clip portion to be disposed at the breach end of said chamber;

a second drum rotatably mounted internally of said chamber at the other end of said housing opposite said first drum;

each of said drums having a plurality of spaced gear teeth about the outer peripheries thereof, one of said drums being an idler drum, the other of said drums being a drive drum; and an endless belt encircling said drums and having spaced gear teeth on the interior thereof directly engaging and meshing with the gear teeth on said drums whereby rotation of said drums rotates said belt;

said belt being spaced from the inner walls of said outer peripheral wall and having one end thereof entering said clip portion wrapping around said first drum past said chamber and having a plurality of spaced cartridge receiving chambers extending along the outer periphery of said belt, each of said cartridge receiving chambers being generally concave in cross-section and extending across the outer peripheral face of said belt in an axial direction generally normal to the direction of rotation of said belt when said belt is rotated by said drums; and motive means engaging said drive drum for rotating said drive drum thereby rotating said belt to present selective ones of said cartridge receiving chambers on said belt into the interior of said clip portion for direct ejection of a cartridge therein directly into the firing chamber.

2. In the magazine of claim 1 wherein said motive means is a spring motor adapted to be rotation in only one direction, is disposed within said drive drum, and said drive drum is disposed at the bottom of said housing.

3. In the magazine of claim 2 wherein at least a portion of said front wall is of a transparent material so that the interior of said housing is visible.

4. In the magazine of claim 3 wherein said front wall is hingedly secured to said outer peripheral wall.

5. In the magazine of claim 1 including indicia means on said belt adjacent each of said belt chambers to indicate the loaded capacity of said belt.

6. In the magazine of claim 1 including a plurality of cartridges disposed in a plurality of said chambers on said belt along the axial concavities therein, the spacing between the inner concave walls of said belt chambers and the inner wall of said outer peripheral wall of said housing being slightly greater than the diameter of the cartridges inserted into said belt chambers thereby retaining said cartridges loosely in position in said belt chambers between said concave walls and said inner wall.

7. In the magazine of claim 6 including axial movement limiting means on said housing for limiting axial movement of said cartridges out of said belt chambers.

8. In the magazine of claim 7 wherein said axial movement limiting means includes the spacing between said front and rear walls and said front and rear ends of said cartridges.

9. In the magazine of claim 1 including rotation limiting means on said belt for limiting rotation thereof after a predetermined number of belt chambers have entered into the interior of said clip portion.

10. In the magazine of claim 1 wherein said housing and said belt are made of molded plastic.

* * * * *